US005894255A

United States Patent [19]

Wallintin

[11] Patent Number: 5,894,255

[45] Date of Patent: Apr. 13, 1999

[54] ELECTROMECHANICAL RELAY

[75] Inventor: James M. Wallintin, Ontario, Calif.

[73] Assignee: Allegheny Ludlum Corporation, Pittsburgh, Pa.

[21] Appl. No.: 09/073,691

[22] Filed: May 6, 1998

[51] Int. Cl.[6] ..... H01H 51/22

[52] U.S. Cl. ..... 335/80; 335/124; 335/128; 335/4

[58] Field of Search ..... 335/4, 5, 78–86, 335/106, 114, 117, 119–120, 121, 124, 128; 333/105

[56] References Cited

U.S. PATENT DOCUMENTS

| | | | |
|---|---|---|---|
| 3,694,777 | 9/1972 | Mueller | 335/128 |
| 4,081,772 | 3/1978 | Schuessler et al. | 335/200 |
| 4,101,855 | 7/1978 | Drapeau | 335/106 |

OTHER PUBLICATIONS

Teledyne Relays Series RF310, RF313 Brochure, 1997.

Teledyne Relays Series RF320, RF323 Brochure, 1997.

Teledyne Relays Series RF300, RF303 Brochure, 1994.

*Primary Examiner*—Lincoln Donovan

*Attorney, Agent, or Firm*—Robert J. Pugh

[57] ABSTRACT

The present disclosure is directed to a relay. The relay includes a frame and a header seal assembly base having contacts and a return spring. The relay also includes an armature assembly which engages the return spring. The armature assembly has at least one actuator. The relay further includes a core assembly located on the armature assembly. The core assembly has an end engaging the frame. The relay also includes a coil shim having a cutout section. The coil shim is connected to the frame and the cutout section engages the armature assembly when the relay is in the de-energized state. The coil shim has an opening for accepting the core assembly. The relay also includes a coil engaging the coil shim. The coil has an opening for accepting the core assembly.

29 Claims, 6 Drawing Sheets

RELEVANT ART

ELECTROMECHANICAL RELAY

I. CROSS-REFERENCE TO RELATED APPLICATIONS (Not Applicable)

II. STATEMENT REGARDING FEDERALLY SPONSORED RESEARCH (Not Applicable)

III. BACKGROUND OF THE INVENTION

1. Field of the Invention

The present invention is directed generally to an electromechanical relay and, more particularly, to an RF relay with high insertion loss repeatability.

2. Description of the Background

Ultraminiature electromechanical relays are used in many test equipment circuits, instrumentation circuits, communication circuits, attenuator circuits, RF signal pulse generator circuits, tower mount amplifier bypass circuits, and other applications where signals are at low power levels and high frequencies. In such applications, it is expected that a relay's radio frequency (RF) insertion loss value is repeatable over the applied signal frequency range. Thus, when the system which contains the relay is calibrated to an RF insertion loss value at some frequency, it is expected that the RF insertion loss value of the signal path through the relay shall be the same value or repeat within an acceptable maximum deviation on subsequent operation of the device in which the relay is incorporated. General purpose direct current (DC) ultraminiature electromechanical relays were not specifically designed to handle RF signals and thus do not provide repeatable RF output signals through the relay signal path for the applicable frequency band with high reliability.

The relevant art has incorporated coil shims in relays with tall frames and long coils to provide structural support for the motor assembly components. Relevant art relays with short frames and short coils do not include coil shims. However, the coils shims were not added with the express purpose of improving the RF performance of the relays. The relevant art has also incorporated a cutout section in the coil shim of relays with tall coils near the forward actuator bead end of the armature when the relays are in the de-energized state. Such cutout sections are not bent and are used as identification marks.

FIG. 14 is a diagram illustrating a relay 10 from the relevant art. The relay 10 is shown in its de-energized state, i.e. when no voltage is applied across coil 12. The relay 10 includes a stop component 14 which is welded to the top side of a header seal assembly base 16. The stop component 14 limits the clockwise rotation, or downward movement, of an armature assembly 18 in the relay 10. When the coil 12 is de-energized, the armature 18 rests on the stop component 14. The stop component 14 may be adjusted up or down to vary the gap between the armature 18 and a motor assembly frame pole face 20. The moment arm from a fulcrum edge 21 of a core assembly 19 to where the stop component 14 is located is larger than the moment arm from the fulcrum edge 21 of the core assembly 19 to the point where a return spring 17 pushes against the armature 18. Thus, the normal force at the stop component 14 to the corresponding armature 18 location is relatively small.

The relay 10 has the disadvantage that it does not have significant reliability of RF signal repeatability over the frequency range of low frequencies to frequencies of 3 GHz and above because the relay does not provide an effective ground circuit for RF signals when it is in the de-energized state. RF signals which travel along the path of moving contacts 15 and upper stationary contacts 13 radiate, or leak out of the path. The radiation causes signal losses at random, resulting in non-repeatability of the relay's RF insertion loss characteristics during operation. Thus, there is a need for a relay that has an RF insertion loss value which is repeatable over the applied signal frequency range.

IV. SUMMARY OF THE INVENTION

The present invention is directed to a relay. The relay includes a frame and a header seal assembly base having contacts and a return spring. The relay also includes an armature assembly which engages the return spring. The armature assembly has at least one actuator. The relay further includes a core assembly located on the armature assembly. The core assembly has an end engaging the frame. The relay also includes a coil shim having a cutout section. The coil shim is connected to the frame and the cutout section engages the armature assembly when the relay is in the de-energized state. The coil shim has an opening for accepting the core assembly. The relay also includes a coil engaging the coil shim. The coil has an opening for accepting the core assembly.

The present invention represents a substantial advance over prior relays. The present invention has the advantage that it allows for a relay that has an RF insertion loss value which is repeatable over the applied signal frequency range.

V. BRIEF DESCRIPTION OF THE DRAWING

For the present invention to be clearly understood and readily practiced, the present invention will be described in conjunction with the following figures, wherein.

VI. DETAILED DESCRIPTION OF THE INVENTION

Figure 1:
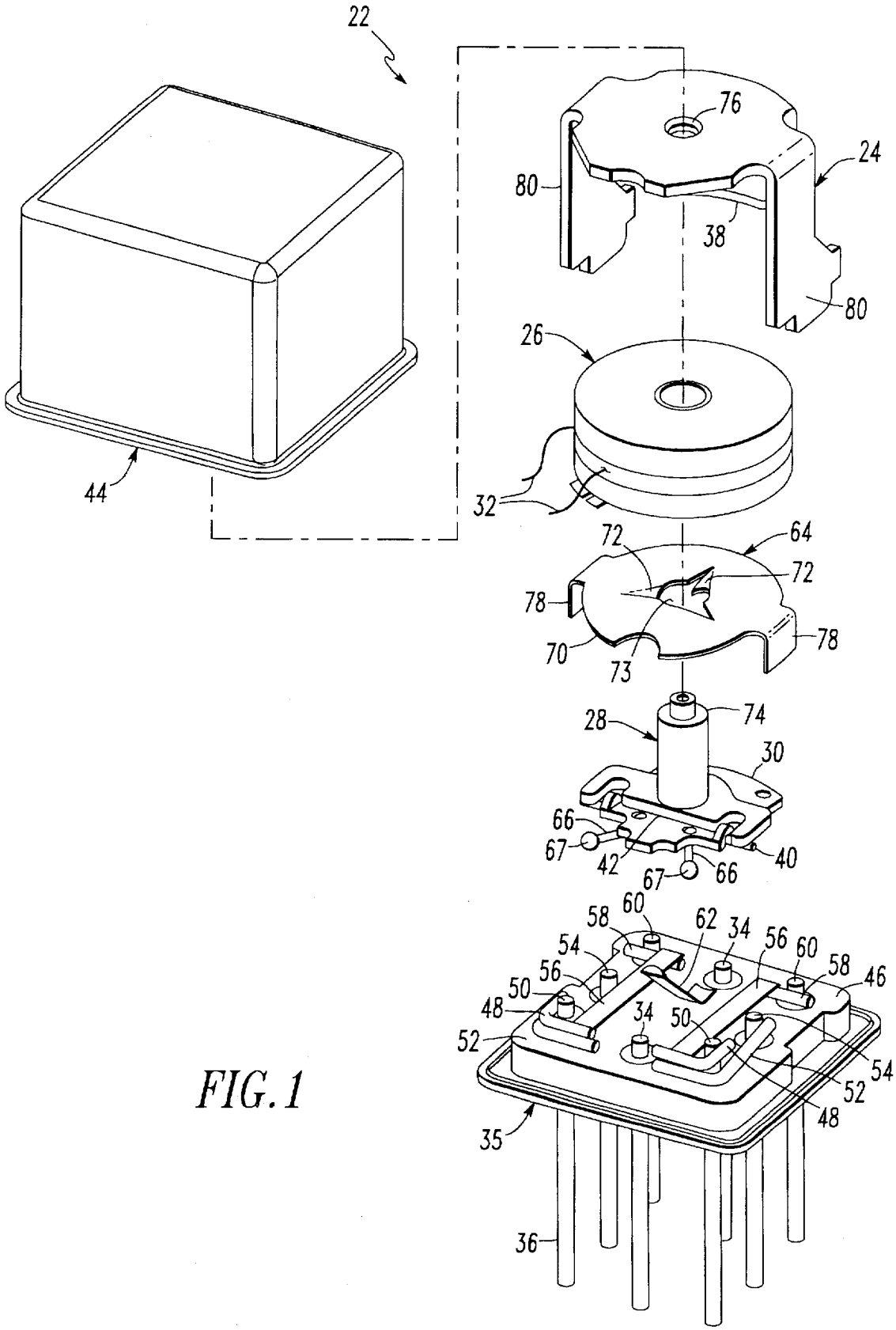
FIG. 1 is a diagram illustrating an exploded assembly view of a relay.

FIG. 1 is a diagram illustrating an exploded assembly view of a relay 22. A frame 24, a coil 26, a core assembly 28, and an armature 30 comprise an electromagnetic circuit in the relay 22. The armature 30 is a movable component and its position is dependent on whether a voltage is applied across the coil 26. The frame 24 can be constructed of any material which provides high magnetic efficiency and mechanical rigidity to the relay 22 such as, for example, metal. Coil leads 32 are connected to coil lead posts 34, which are portions of terminals 36 that extend through a header seal assembly base 35, and to the coil 26. The coil leads 32 can be attached to the coil lead posts 34 and the coil 26 by any suitable connection method such as, for example, welding.

When voltage is applied across the two terminals 36 which correspond to the lead posts 34, the resultant current passes through the coil leads 32 and magnet wire turns (not shown) in the coil 26. The current and wire turns, i.e. amp-turns, create a magnetic field such that magnetic flux is distributed throughout the electromagnetic circuit in the relay 22. The magnetic flux which links a frame pole 38 of the frame 24, the core assembly 28, and the armature 30 results in the magnetic forces pulling the armature 30 against the frame pole 38. The armature 30 is restrained from side-to-side, up-and-down, and fore-and-aft movements by pivot pins 40. Rotation of the armature 30 is thus constrained to rotation by pivoting about a fulcrum edge 42 of the core assembly 28.

To complete the description of the relay 22 in FIG. 1, a cover 44 is attached to the header seal assembly base 35 and a header base 46. The cover 44 can be hermetically sealed to the header seal assembly base 35 and the header base 46. The cover 44 can be constructed of any material which shields the relay 22 from electromagnetic interference such as, for example, metal. Upper stationary contacts 48 are connected to lead posts 50. Lower stationary contacts 52 are connected to lead posts 54, and moving contacts 56 are connected to crossbars 58, which are connected to lead posts 60. The contacts 48, 52, and 56 can be constructed of any material which ensures reliable switching such as, for example, a gold plated precious metal alloy. When the relay 22 is used in an attenuator circuit, the upper stationary contacts 48 can be connected by an external circuit through-path on a printed circuit board and the lower stationary contacts 52 can be connected across the attenuator pad resistive circuit. This arrangement can be reversed if used in an attenuator circuit in which such a reverse arrangement is required. A return spring 62 is connected to the header base 46. A motor assembly consists of the frame 24, the coil 26, a coil shim 64, the core assembly 28, the pivot pins 40, the armature 30, and actuators 66. The metal components of the relay 22 are connected by welds. Welding of the components of the relay 22 provides the relay 22 with high resistance to shock and vibration.

Figure 2:
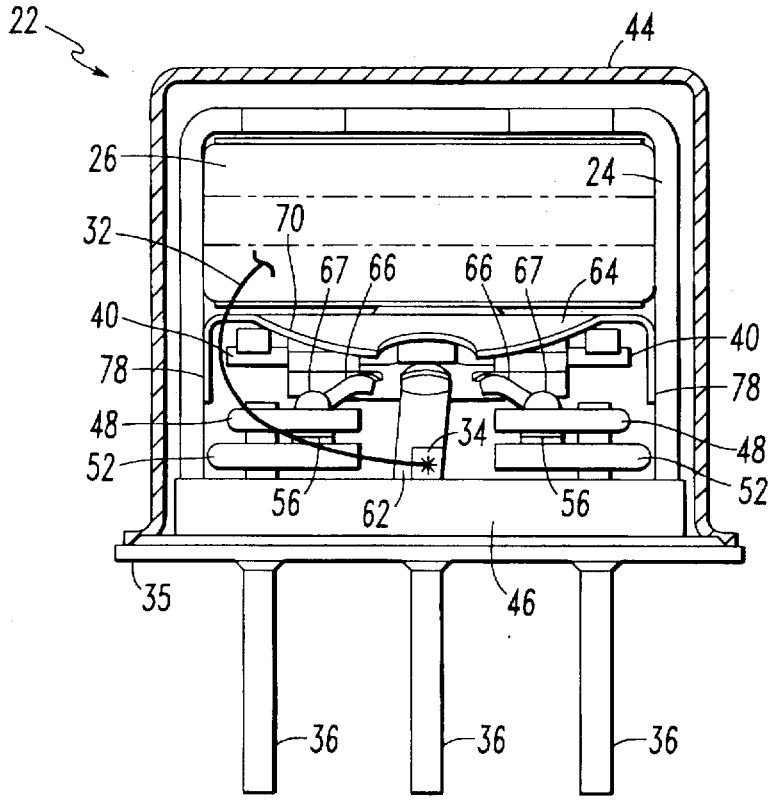
FIG. 2 is a diagram illustrating a frontal cutaway view of the assembled relay of FIG. 1 in the de-energized state.
Figure 3:
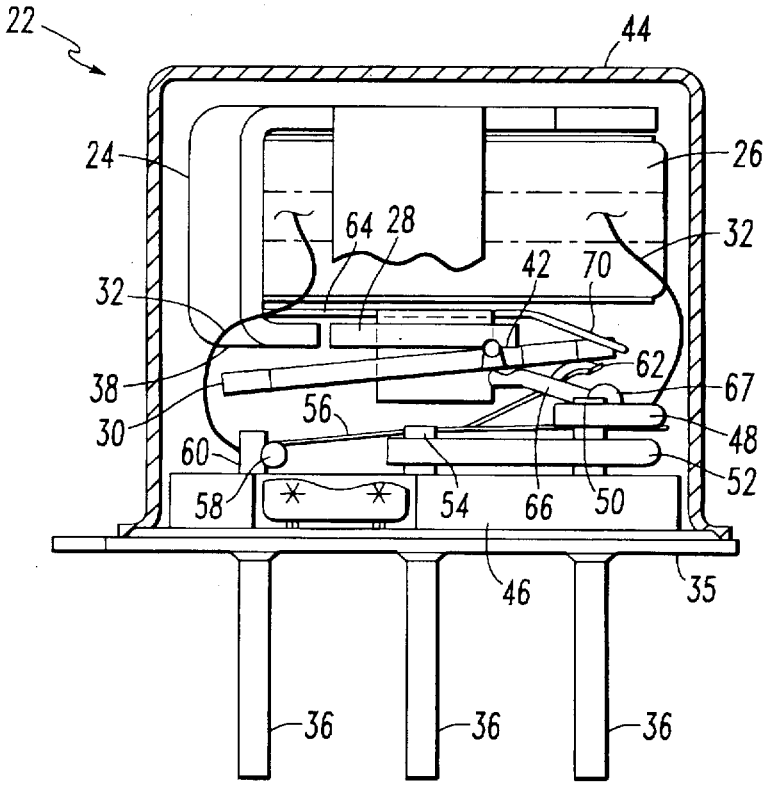
FIG. 3 is a diagram illustrating a side cutaway view of the assembled relay of FIG. 1 in the de-energized state.
Figure 4:
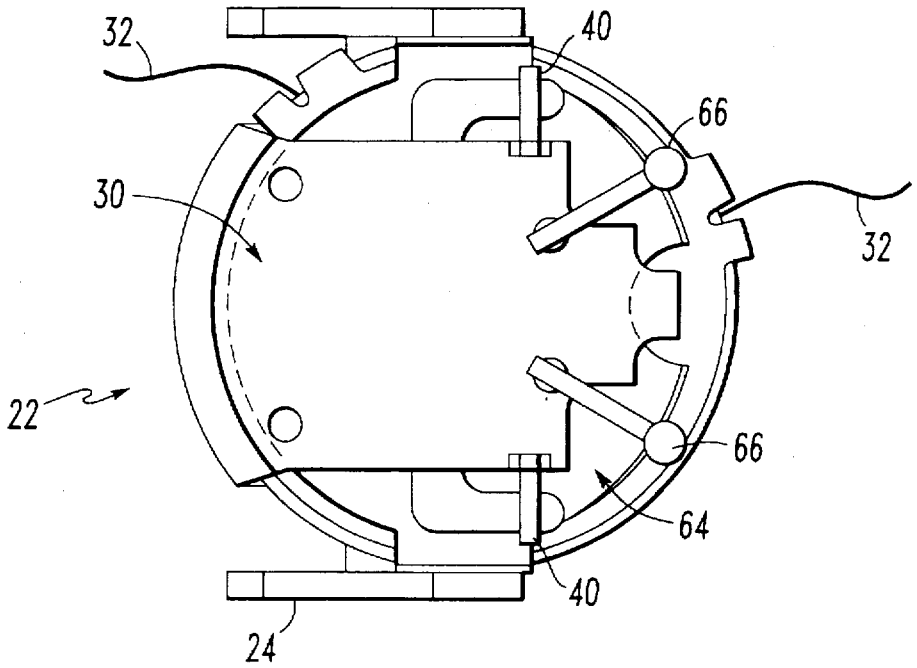
FIG. 4 is a bottom view of the relay of FIG. 1 without the header seal assembly and the components located thereon.

FIG. 2 is a diagram illustrating a frontal cutaway view of the assembled relay 22 in the de-energized state and FIG. 3 is a diagram illustrating a side cutaway view of the assembled relay 22 in the de-energized state. FIG. 4 is a diagram illustrating a bottom view of the relay 22 without the header seal assembly base 35 and the components located thereon.

Figure 5:
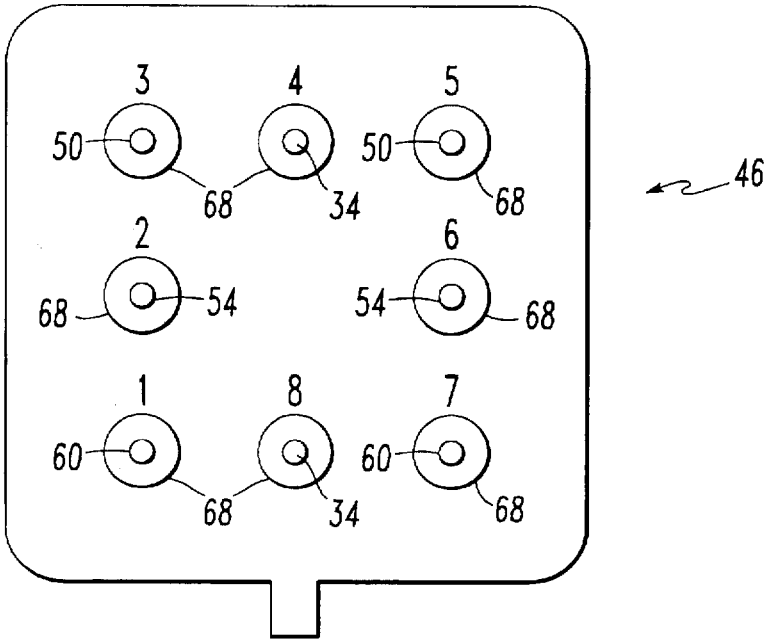
FIG. 5 is a bottom view of the header base of the relay of FIG. 1.

FIG. 5 is a bottom view of the header base 46. The terminals 36 (illustrated in FIGS. 1–3) project through the base 46 and terminate as the lead posts 34, 50, 54, and 60. The lead posts 34, 50, 54, and 60 are numbered 1 through 8 for reference so that each lead post can be matched with a terminal on the underside of the header seal assembly base 35. The terminals 36 are electrically insulated from the base 46, which may be constructed of a conductive metal, such as with insulator glass seals 68. Although the relay 22 is illustrated in FIGS. 1 through 5 as having the terminals 36 arranged in a grid pattern, the relay 22 may also incorporate other arrangements of terminals 36 such as, for example, a circular arrangement.

The operation of the relay 22 is now described. When no voltage is applied across the coil 26, i.e. when the relay 22 is in a de-energized state, the moving contacts 56 have preset preload against the upper stationary contacts 48. This results in normal contact forces at all normally closed contact make areas. When the relay 22 is in the de-energized state, the signal path for the first contact pole is from the No. 1 terminal to the No. 3 terminal, or vice versa (see FIG. 5). The signal path for the second contact pole is from the No. 7 terminal to the No. 5 terminal, or vice versa (see FIG. 5). In the de-energized state, there is a preset gap between bottom side of the moving contacts 56 and the lower stationary contacts 52 (see FIG. 3). Also, the armature 30 is forced upward by the return spring 62 against a cutout section 70 in the coil shim 64 (see FIGS. 1–3). The cutout section 70 contains a cutout and is bent relative to the coil shim 64. The cutout section 70 acts to limit the upward movement, and hence the counterclockwise rotation, of the armature 30 with respect to the fulcrum edge 42 of the core assembly 28.

When a voltage is applied across the coil 26, i.e. when the relay is in the energized state, the armature 30 moves away from the coil shim 64 and continuing clockwise rotation of the armature 30 causes the free ends of the actuators 66, which have insulative beads 67 attached thereto, to strike the moving contacts 56, which relieves the preload between the upper stationary contacts 48 and the moving contacts 56 (See FIGS. 1–3). The insulative beads 67 can be constructed of a material such as, for example, glass. Continuing clockwise rotation of the armature 30 causes the insulative beads 67 on the ends of the actuators 66 to push down on the moving contacts 56 until contact is made with the lower stationary contacts 52. As the armature 30 completes its clockwise rotation, additional elastic downward deflection, referred to as overtravel, of the moving contacts 56 and the lower stationary contacts 52 occurs due to the preset downward motion of the insulative beads 67 on the actuators 66 when the armature 30 is pulled against the frame pole 38.

In the energized state of the relay 22, the normal forces at the normally open contact make areas are due to the moving contacts 56 being forced against the lower stationary contacts 52. The signal path in the energized state for the first contact pole is from the No. 1 terminal to the No. 2 terminal, or vice versa. The signal path in the energized state for the second contact pole is from the No. 7 terminal to the No. 6 terminal, or vice versa.

When voltage is removed from the coil 26, the return spring 62 pushes against the armature 30 and the moving contacts 56 push against the insulative beads 67 on the actuators 66, which causes the armature 30 to rotate in the counterclockwise direction about the fulcrum edge 42 of the core assembly 28 until the armature 30 is stopped by the cutout section 70 in the coil shim 64.

The coil shim 64 improves the RF characteristics and the RF insertion loss repeatability characteristics of the relay 22. The coil shim 64 may be constructed of metal and is retained between the bottom side of the coil 26 and the top side of the head of the core assembly 28. Tangs 72 at a center hole 73 of the coil shim 64 bear down against the top side of the head of the core assembly 28 when core shank pilot 74 on the top of the core assembly 28 is mechanically staked on the top side of hole 76 in the frame 24. The coil shim 64 may be connected to the inside surfaces of legs 80 of the frame 24 at bent tabs 78 such as by welding.

The coil shim 64 acts as a structural support to limit pendulum-type movement, with respect to the top hole 76 of the frame 24, when the combined mass of the armature 30, the actuators 66, the core assembly 28, and the coil 26 are subjected to lateral acceleration loads. The coil shim 64 also acts as a mechanical limit stop for the armature 30 when the relay 22 is in the de-energized state. The cutout section 70 in the coil shim 64 acts to stop and center the armature 30 in the de-energized state.

When the relay 22 is in the de-energized state as illustrated in FIGS. 2 and 3, the armature 30 makes contact with the cutout section 70 in the coil shim 64. The location where the armature 30 rests on the coil shim 64 is approximately the same location, with respect to the fulcrum edge 42 of the core assembly 28, as the location where the return spring 62 pushes on the armature 30. Thus, the normal force created at the cutout section 70 on the coil shim 64 and the corresponding armature 30 surface is approximately equal to the force of the return spring 62 acting on the armature 30. This relatively high normal force at the cutout section 70 in the coil shim 64 and the corresponding armature 30 location results in a consistent resistance path to ground for the relay 22 during each relay operation after the voltage applied to the coil 26 is removed. The consistent resistance path to ground results in a repeatable insertion loss measurement for the normally closed upper stationary contacts 48.

The header seal assembly base 35 and the header base 46 can be connected to the electrical circuit ground plane, typically by soldering at discrete points or entirely around the external periphery of the cover 44 and the header seal assembly base 35. Because the coil shim 64 is connected to the legs 80 of the frame 24 and the frame 24 is connected to the header base 46, the coil shim 64 and the frame 24 are also connected to the electrical circuit ground plane. This arrangement makes the armature 30 an integral part of the ground circuit loop when the relay 22 is in the de-energized state and the armature 30 is forced against the cutout section 70 in the coil shim 64. When the armature 30 is in contact with the cutout section 70 in the coil shim 64, the armature 30 is equal in electric potential to the header base 46, which is connected to the electrical circuit ground plane. The coil shim 64 and the armature 30 are above the moving contacts 56 and the header base 46 is below the moving contacts 56. The coil shim 64, the armature 30, the moving contacts 56, and the header base 46 form an RF microwave stripline structure that is essentially a shielded transmission path. This configuration guides the RF signal along the path of the moving contacts 56 and the upper stationary contacts 48. The stripline transmission configuration leads to improved RF insertion loss repeatability performance and improved RF characteristics.

When the relay 22 is in the energized state, the armature 30 is forced against the head of the core assembly 28 and the frame pole 38. The armature 30 becomes an integral part of the ground circuit loop via the head of the core assembly 28 which is in contact with the coil shim 64. The coil shim 64 and the armature 30 are above the moving contacts 56, thus forming an RF stripline structure. The stripline configuration leads to improved RF insertion loss repeatability performance and improved RF characteristics.

Although the relay 22 has been illustrated herein as a square-shaped ultraminiature relay with terminals on a 0.100 inch grid pattern and with double-pole double-throw type contacts, the invention described is also applicable with other types of relays having, for example, a 0.200 inch basic circular pattern. The invention described herein is also applicable to relays which have single-pole double-throw, double-pole single-throw, or single-pole single-throw contacts.

Figure 6:
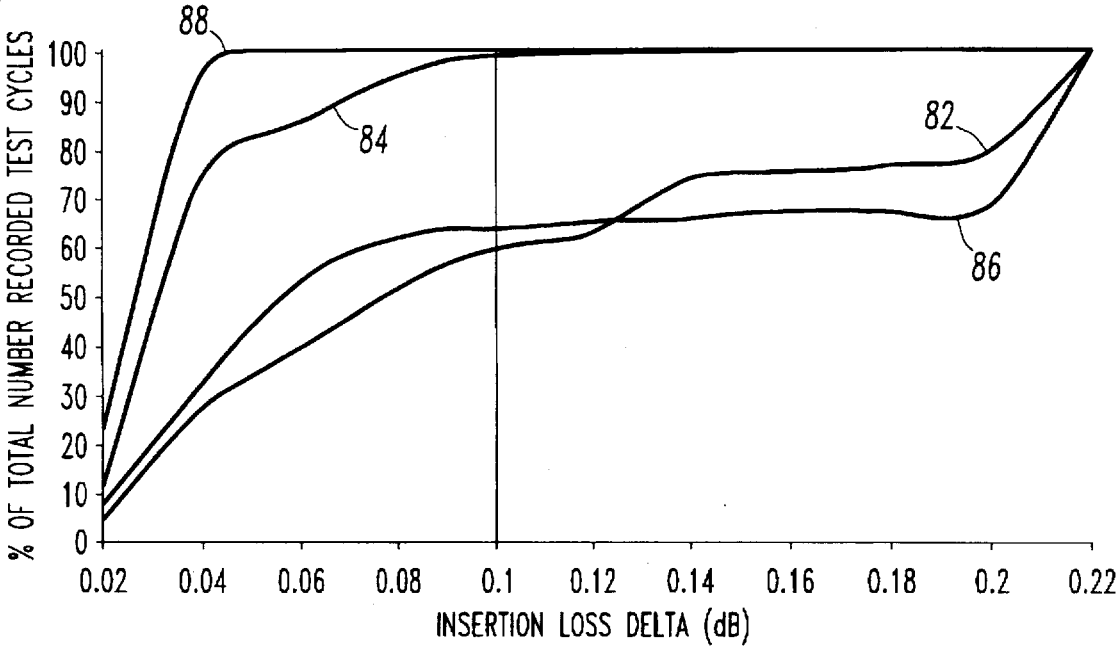
FIG. 6 is a graph of the RF insertion loss repeatability of a relay constructed according to the teachings of the present invention and a Teledyne Relays 114 relay.

FIG. 6 illustrates a graph of the RF insertion loss repeatability of a relay constructed according to the teachings of the present invention and a Teledyne Relays 114 relay. The graph illustrates the percentage of the total number of recorded test cycles versus the insertion loss delta in decibels.

The insertion loss for tested samples of the 114 relay normally closed signal path is illustrated in FIG. 6 as 82. The insertion loss for tested samples of the present invention normally closed signal path is illustrated in FIG. 6 as 84. The insertion loss for tested samples of the 114 relay normally open signal path is illustrated in FIG. 6 as 86. The insertion loss for tested samples of the present invention normally open signal path is illustrated in FIG. 6 as 88.

Figure 7:
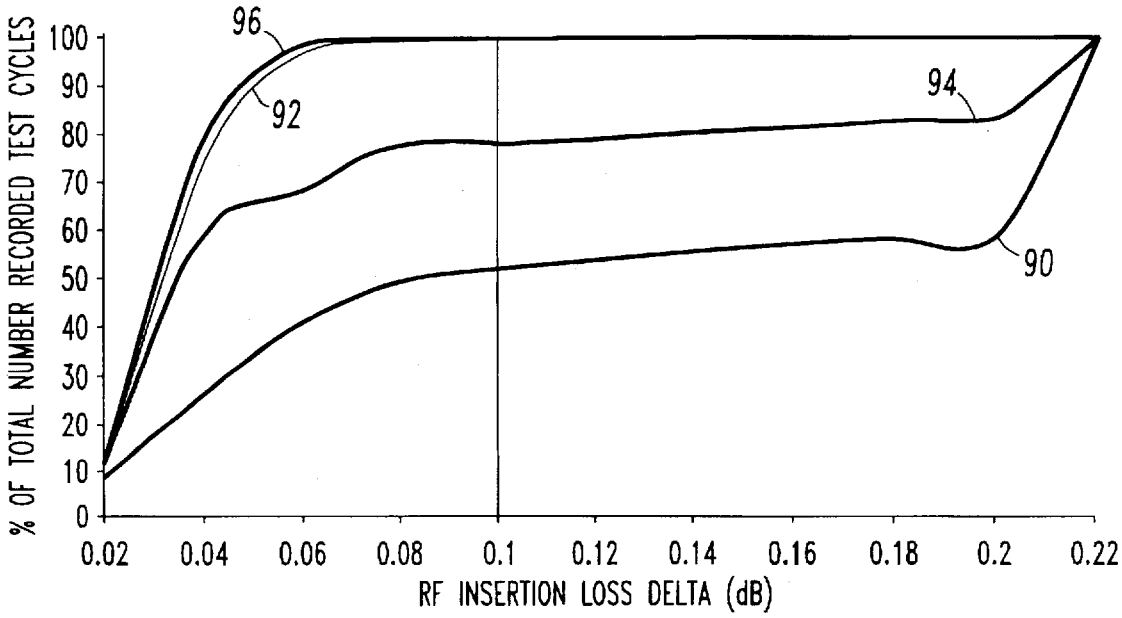
FIG. 7 is a graph of the RF insertion loss repeatability of a relay constructed according to the teachings of the present invention and a Teledyne Relays 172 relay.

FIG. 7 illustrates a graph of the RF insertion loss repeatability of a relay constructed according to the teachings of the present invention and a Teledyne Relays 172 relay. The graph illustrates the percentage of the total number of recorded test cycles versus the insertion loss delta in decibels.

The insertion loss for tested samples of the 172 relay normally closed signal path is illustrated in FIG. 7 as 90. The insertion loss for tested samples of the of the present invention normally closed signal path is illustrated in FIG. 7 as 92. The insertion loss for tested samples of the 172 relay normally open signal path is illustrated in FIG. 7 as 94. The insertion loss for tested samples of the present invention normally open signal path is illustrated in FIG. 7 as 96.

Figure 8:
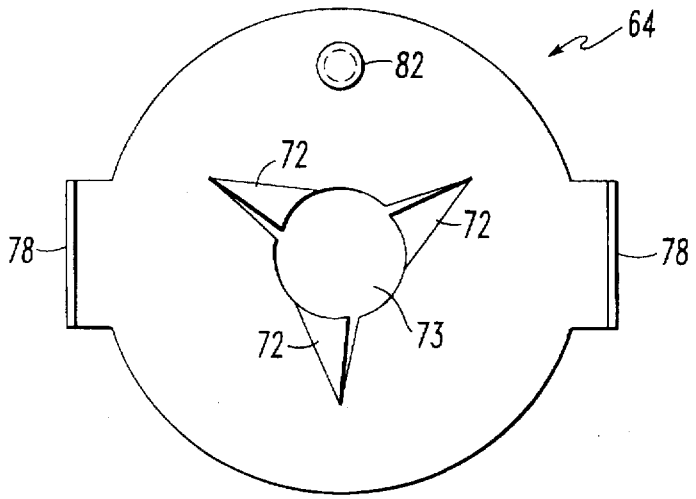
FIG. 8 is a bottom view of another embodiment of the coil shim of FIG. 1.
Figure 9:
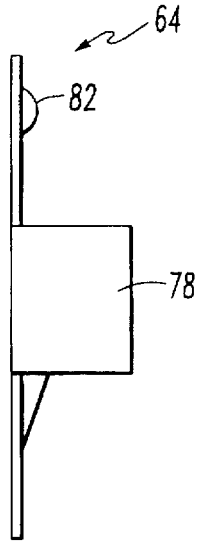
FIG. 9 is a side view of the coil shim of FIG. 8.

FIG. 8 illustrates a bottom view of another embodiment of the coil shim 64 of FIG. 1. A circular-shaped protrusion 82 acts to stop and center the armature 30 when the relay 22 is in the de-energized state, similar to the cutout section 70 of the coil shim 64 described hereinabove. FIG. 9 illustrates a side view of the coil shim 64 of FIG. 8.

Figure 10:
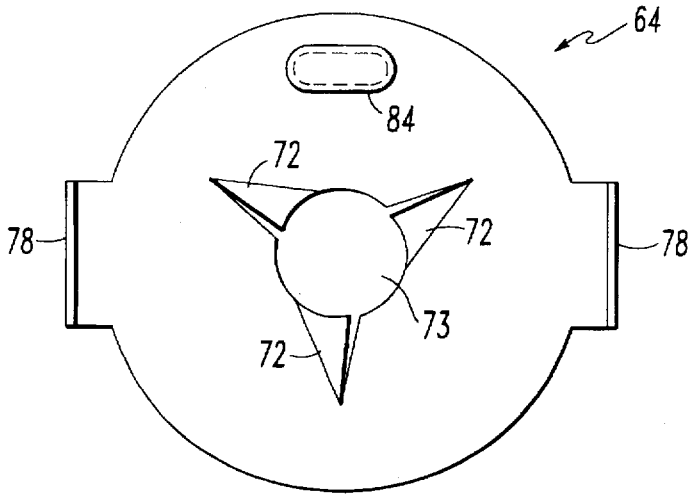
FIG. 10 is a bottom view of another embodiment of the coil shim of FIG. 1.
Figure 11:
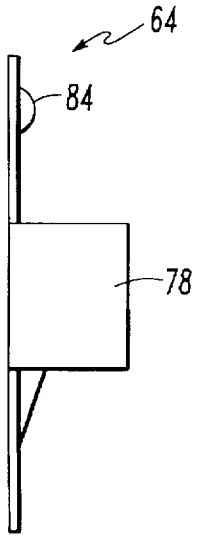
FIG. 11 is a side view of the coil shim of FIG. 10.

FIG. 10 illustrates a bottom view of another embodiment of the coil shim 64 of FIG. 1. An elongated protrusion 84 acts to stop and center the armature 30 when the relay 22 is in the de-energized state, similar to the cutout section 70 of the coil shim 64 described hereinabove. FIG. 11 illustrates a side view of the coil shim 64 of FIG. 10.

Figure 12:
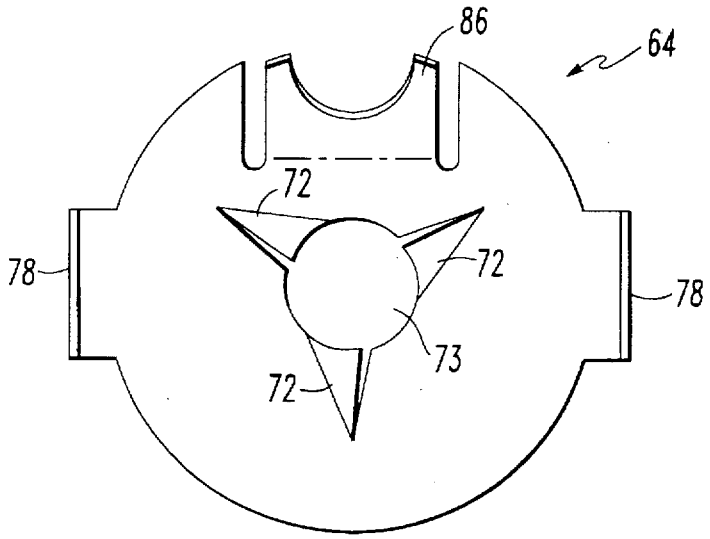
FIG. 12 is a bottom view of another embodiment of the coil shim of FIG. 1.
Figure 13:
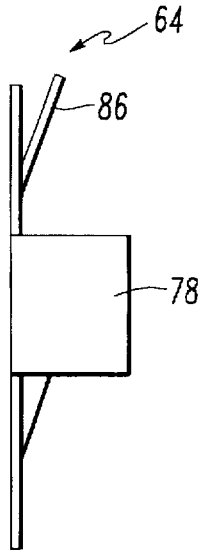
FIG. 13 is a side view of the coil shim of FIG. 12.
Figure 14:
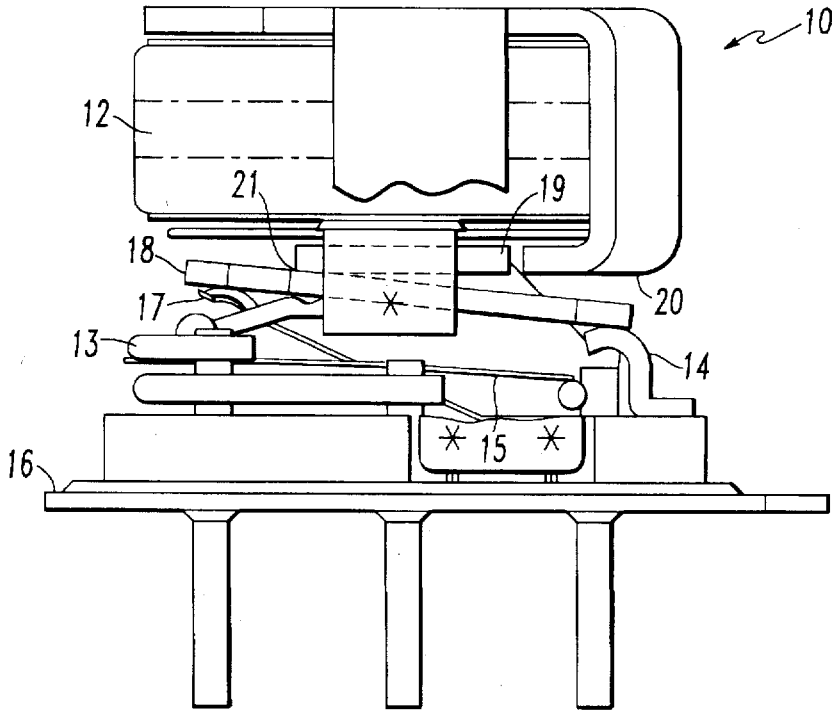
FIG. 14 is a diagram illustrating a relay from the relevant art.

FIG. 12 illustrates a bottom view of another embodiment of the coil shim 64 of FIG. 1. A leaf spring member 86 acts to stop and center the armature 30 when the relay 22 is in the de-energized state, similar to the cutout section 70 of the coil shim 64 described hereinabove. FIG. 13 illustrates a side view of the coil shim 64 of FIG. 12.

While the present invention has been described in conjunction with preferred embodiments thereof, many modifications and variations will be apparent to those of ordinary skill in the art. For example, the cutout section 70 in the coil shim 64 could be shaped in any manner so as to stop the rotation of the armature 30. Also, the relay 22 may be constructed with 1 stationary contact and 1 moving contact. The foregoing description and the following claims are intended to cover all such modifications and variations.

What is claimed is:

1. A relay, comprising:

a frame;

a header seal assembly base having a plurality of contacts and a return spring;

an armature assembly engaging said return spring, said armature assembly having at least one actuator;

a core assembly located on said armature assembly, said core assembly having an end engaging said frame;

a coil shim connected to said frame, said coil shim having a bent portion with a cutout, wherein the perimeter of said cutout engages said armature assembly when the relay is in a de-energized state, and said coil shim having an opening for accepting said core assembly; and a coil engaging said coil shim, said coil having an opening for accepting said core assembly.

2. The relay of claim 1 further comprising at least one pivot pin for retaining said armature assembly on said core assembly.

3. The relay of claim 1 wherein said contacts include at least one stationary contact and at least one moving contact.

4. The relay of claim 1 wherein said contacts include a plurality of moving contacts.

5. The relay of claim 1 wherein said contacts include a plurality of upper stationary contacts.

6. The relay of claim 1 wherein said contacts include a plurality of lower stationary contacts.

7. The relay of claim 1 wherein said header seal assembly base has a header base.

8. The relay of claim 7 further comprising a cover connected to said header seal assembly base.

9. The relay of claim 1 further comprising a plurality of lead posts connected to said contacts.

10. The relay of claim 9 further comprising a plurality of terminals connected to said lead posts.

11. The relay of claim 10 further comprising a plurality of insulated glass seals between said terminals and said hearer seal assembly base.

12. The relay of claim 1 wherein said actuator has an insulative bead located on one end.

13. The relay of claim 11 wherein said insulative beads are constructed of glass.

14. The relay of claim 9 further comprising a plurality of coil leads connected between said coil assembly and said lead posts.

15. The relay of claim 1 wherein said armature assembly has a plurality of pivot pins.

16. The relay of claim 1 wherein a normal force created where said cutout section of said coil shim and said armature are engaged and a normal force created where said armature and said return spring are engaged are approximately equal when the relay is in said de-energized state.

17. The relay of claim 16 wherein said cutout section of said coil shim and said return spring engage said armature at approximately the same location on said armature when the relay is in said de-energized state.

18. The relay of claim 17 wherein said cutout section of said coil shim engages one side of said armature and said return spring engages another side of said armature when said relay is in said de-energized state.

19. The relay of claim 17 wherein said cutout section of said coil shim centers said armature when the relay is in said de-energized state.

20. The relay of claim 7 wherein said header seal assembly base, said frame, said core assembly, said armature, and said coil shim are connected to an electrical circuit ground plane.

21. The relay of claim 20 wherein said contacts include a plurality of moving contacts, and wherein said header seal assembly base, said armature, said coil shim, and said moving contacts form an RF stripline structure.

22. A relay, comprising:

a frame;

a header seal assembly base having a plurality of contacts and a return spring;

an armature assembly engaging said return spring while the relay is in a de-energized state, said armature assembly having a plurality of actuators;

a core assembly located on said armature assembly;

a coil shim having a portion thereof forming a means for stopping rotation of said armature assembly when the relay is in said de-energized state, said coil shim having an opening for engaging said core assembly; and a coil engaging said coil shim, said coil having an opening for engaging said core assembly.

23. The relay of claim 22 wherein said means for stopping rotation includes a leaf spring member.

24. The relay of claim 22 wherein said means for stopping rotation includes a cutout section.

25. The relay of claim 22 wherein said means for stopping rotation includes a circular-shaped protrusion.

26. The relay of claim 22 wherein said means for stopping includes an elongated protrusion.

27. A relay, comprising:

a frame;

a header seal assembly base having a plurality of contacts and a return spring;

an armature assembly engaging said return spring, said armature assembly having at least one actuator;

a core assembly located on said armature assembly, said core assembly having an end engaging said frame;

a coil shim connected to said frame, said coil shim having a leaf spring member, said leaf spring member engaging said armature assembly when the relay is in said de-energized state, and said coil shim having an opening for accepting said core assembly; and a coil engaging said coil shim, said coil having an opening for accepting said core assembly.

28. A relay, comprising:

a frame;

a header seal assembly base having a plurality of contacts and a return spring;

an armature assembly engaging said return spring, said armature assembly having at least one actuator;

a core assembly located on said armature assembly, said core assembly having an end engaging said frame;

a coil shim connected to said frame, said coil shim having a circular-shaped protrusion, said protrusion engaging said armature assembly when the relay is in said de-energized state, and said coil shim having an opening for accepting said core assembly; and a coil engaging said coil shim, said coil having an opening for accepting said core assembly.

29. A relay, comprising;

a frame;

a header seal assembly base having a plurality of contacts and a return spring;

an armature assembly engaging said return spring, said armature assembly having at least one actuator;

a core assembly located on said armature assembly, said core assembly having an end engaging said frame;

a coil shim connected to said frame, said coil shim having an elongated protrusion, said protrusion engaging said armature assembly when the relay is in said de-energized state, and said coil shim having an opening for accepting said core assembly; and a coil engaging said coil shim, said coil having an opening for accepting said core assembly.

* * * * *